US010380979B2

(12) United States Patent
Shires

(10) Patent No.: US 10,380,979 B2
(45) Date of Patent: Aug. 13, 2019

(54) TWIN VALVE ATTACHMENT FOR MUSICAL INSTRUMENTS

(71) Applicant: EASTMAN BRASS INSTRUMENTS, LLC, Hopedale, MA (US)

(72) Inventor: Stephen Shires, Waterbury Center, VT (US)

(73) Assignee: EASTMAN BRASS INSTRUMENTS, LLC, Hopedale, MA (US)

( * ) Notice: Subject to any disclaimer, the term of this patent is extended or adjusted under 35 U.S.C. 154(b) by 0 days.

(21) Appl. No.: 15/724,878

(22) Filed: Oct. 4, 2017

(65) Prior Publication Data

US 2019/0103077 A1 Apr. 4, 2019

(51) Int. Cl.

| | |
|---|---|
| ***G10D 9/04*** | (2006.01) |
| ***G10D 7/10*** | (2006.01) |
| ***G10D 9/00*** | (2006.01) |

(52) U.S. Cl.

CPC ..... *G10D 9/04* (2013.01); *G10D 7/10* (2013.01); *G10D 9/005* (2013.01)

(58) Field of Classification Search

CPC ..... G10D 9/04; G10D 7/10

See application file for complete search history.

(56) References Cited

U.S. PATENT DOCUMENTS

| | | | | |
|---|---|---|---|---|
| 1,244,745 | A | | 10/1917 | King |
| 2,003,995 | A | | 6/1935 | Einhorn |
| 2,484,408 | A | | 10/1949 | Hubley |
| 3,631,755 | A | * | 1/1972 | Glantz ..... G10D 7/10 84/388 |
| 3,641,863 | A | | 2/1972 | Kanstul et al. |
| 3,881,388 | A | | 5/1975 | McCracken |
| 4,112,806 | A | | 9/1978 | Thayer |
| 4,469,002 | A | | 9/1984 | Thayer |
| 5,012,714 | A | | 5/1991 | Kongou |
| 5,686,678 | A | | 11/1997 | Greenhoe |
| 6,026,845 | A | | 2/2000 | Walrath et al. |
| 6,109,293 | A | | 8/2000 | Walrath et al. |
| 6,279,595 | B1 | | 8/2001 | Walrath et al. |
| 6,557,576 | B2 | | 5/2003 | Walrath et al. |
| 7,112,735 | B2 | | 9/2006 | Shire |
| 2002/0005218 | A1 | | 1/2002 | Walrath et al. |
| 2003/0192593 | A1 | | 10/2003 | Walrath et al. |

OTHER PUBLICATIONS

Mccracken Tri-Valve Horn, Jul. 22, 2012.

(Continued)

*Primary Examiner* — Kimberly R Lockett

(74) *Attorney, Agent, or Firm* — Risso I.P.

(57) ABSTRACT

Described is a twin valve attachment for musical instruments, such as a trombone. The attachment includes a lever that is rotatable between a B-Flat configuration and an F note configuration. Also included are first and second rotary valves. The first rotary valve is operably connected with the F lever, while the second rotary valve is operably connected with the first rotary valve. F-attachment piping is fluidly connected with both the first and second rotary valves. Thus, a user may rotate the F lever to selectively direct air flow through the F-attachment piping (for the F note configuration) or bypass the F-attachment piping (for the B-Flat configuration).

13 Claims, 11 Drawing Sheets

(56) References Cited

OTHER PUBLICATIONS

Haggman valve, Noah Gladstone's Brass Ark, 2010.
Bach "K" Valve, found at https://www.youtube.com/watch?v=G_zh5FAiXUw, Jan. 20, 2015.
Mike Olson Valve found at https://www.facebook.com / JamesLangenbergBrassRepairTechincian/photos/pcb.133228940031902/1733228550031941/?type=3&theater, Sep. 25, 2017.

* cited by examiner

TWIN VALVE ATTACHMENT FOR MUSICAL INSTRUMENTS

BACKGROUND OF THE INVENTION

(1) Field of Invention

The present invention relates to musical instruments and, more particularly, to a twin-valve attachment for use with musical instruments, such as a trombone.

(2) Description of Related Art

Over the years a variety of musical instruments have been developed, each providing a unique operation and resulting sound. Brass instruments, for example, are musical instruments that produce sound by vibration of air in a tubular resonator in sympathy with the vibration of the player's lips. Several brass instruments have been developed that allow the player to alter the note during a performance by changing the flow of air within the instrument.

A trombone, for example, traditionally includes a slide tube that allows the player to selectively alter the length of the tubing within the instrument. As an enhancement to a traditional trombone and as shown in FIGS. 1A and 1B, most Bp orchestral trombones have an F-attachment 102 which is a valve 104 and connected tubing 106 allowing the player to add a perfect fourth to the length of the trombone. This extends the range of the tenor trombone, and allows for certain "alternate positions", giving the player more options on the position the slide must be in to play a given note. For example, FIG. 1A depicts the valve 104 positioned to provide for B Flat by bypassing the F-attachment 102. In other words, the traditional F-attachment 102 comprises a single rotary valve 104 having a pair of passageways that allow a user to selectively rotate the valve to direct airflow into the F-attachment 102 (as shown in FIG. 1B) or bypass the F-attachment 102 (as shown in FIG. 1A).

Most traditional rotary valves 104 have achieved the purpose of adding the extra length of tubing 106, but have had a substantial negative effect on the sound and response of the instrument, particularly on the side with the valve 104 engaged. Further, most valves add significant resistance when used and the sound is both more "stuffy" and less responsive.

Thus, a continuing need exists for a valve system for an attachment that provides ideal response, articulation, sound and "blow" both on the straight instrument (valve not engaged) and "F side" (valve engaged), and such an attachment that can be used for other notes as well.

SUMMARY OF INVENTION

This disclosure provides a twin valve attachment for musical instruments. The twin valve attachment includes an actuator (e.g., lever) positionable (e.g., rotatable) between at least two configurations. A first rotary valve is operably connected with the actuator, the first rotary valve having a first rotary valve port passing therethrough. A second rotary valve is operably connected with the first rotary valve, the secondary rotary valve having a second rotary valve port passing therethrough. Further, attachment piping is fluidly connected with both the first and second rotary valves. Thus, a user may move the actuator to selectively direct air flow through the attachment piping or bypass the attachment piping.

In another aspect, the first rotary valve is rotatable between a first configuration and a second configuration, such that when in the first configuration, the first rotary valve port is directed to fluidly bypass the attachment piping and, when in the second configuration, the first rotary valve port is directed to fluidly connect with the attachment piping.

In yet another aspect, the second rotary valve is rotatable between a first configuration and a second configuration, such that when in the first configuration, the second rotary valve port is directed to fluidly bypass the attachment piping and, when in the second configuration, the second rotary valve port is directed to fluidly connect with the attachment piping.

In yet another aspect, the first and second rotary valves are operably connected with the actuator via linkages such that actuation of the actuator causes the first and secondary rotary valves to rotate in opposite rotational directions.

In another aspect, the first and second rotary valves are operably connected with the actuator via linkages such that actuation of the actuator causes the first and secondary rotary valves to each rotate approximately 120 degrees.

In another aspect, the first and second rotary valve ports are curved ports that curve approximately 120 degrees.

In yet another aspect, the first configuration is a B-Flat configuration and the second configuration is an F note configuration, with the attachment piping being an F-attachment piping.

Additionally, the actuator is a spring-loaded F-lever biased in the B-Flat configuration.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1A:
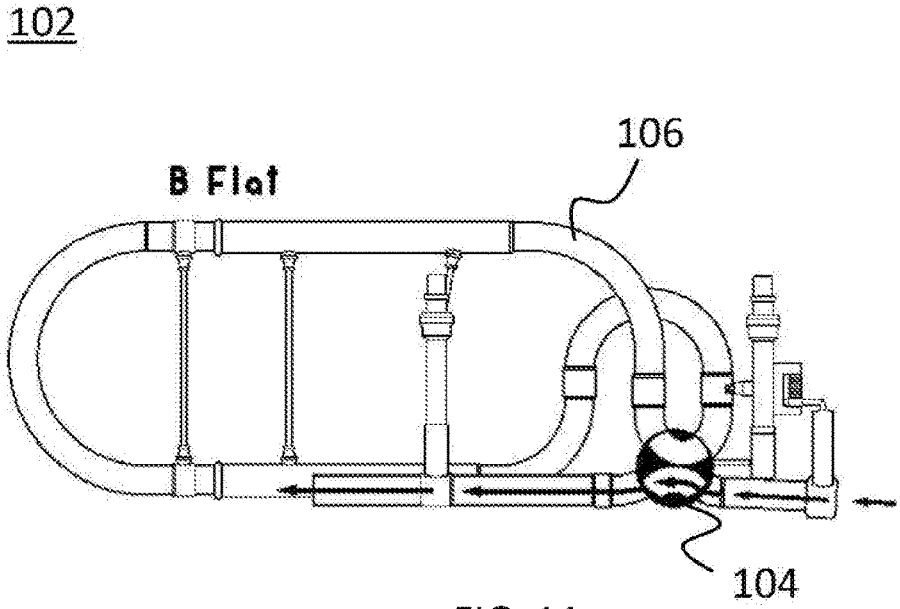
FIG. 1A (Prior Art)
FIG. 1A is a side view illustration of a traditional F-attachment for a trombone, depicting an interior view of a rotary valve in a B-Flat configuration.
Figure 1B:
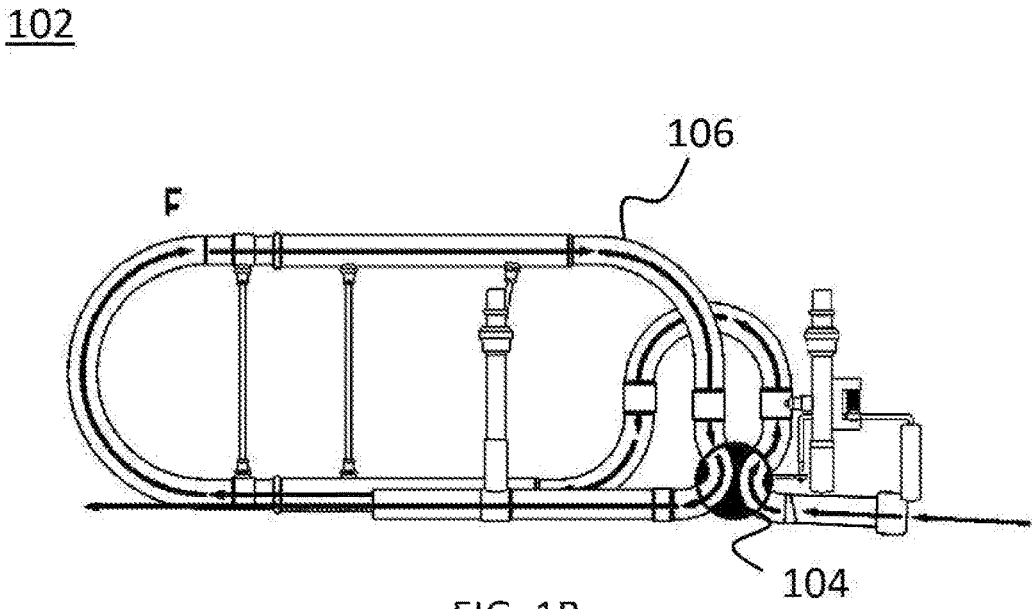
FIG. 1B (Prior Art)
FIG. 1B is a side view illustration of the traditional F-attachment for the trombone, depicting an interior view of the rotary valve in an F note configuration.

The present invention relates to musical instruments and, more particularly, to a twin-valve attachment for use with musical instruments, such as a trombone. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

As noted above, traditional F-attachment valves add significant resistance when used and the sound is both more "stuffy" and less responsive. The present invention improves upon the prior art by providing an instrument that both preserves the natural open sound of a tenor trombone without a valve, but also allows the player to utilize the F-attachment to extend his playing into the lower register, maintaining a very similar sound and response to the rest of the instrument.

The trombone is an instrument that is naturally very open in its response and "blow". This is due in part to very few bends (or degrees of arc) in its design. On a straight trombone there are only 360 degrees of arc in the tubing throughout all of the operating positions. A trumpet has more than three times that with all the valves depressed. A French horn has countless degrees of arc! The best way to maintain the characteristic sound, response, and blow of the trombone would be to utilize the fewest degrees of arc when adding valves, both when the F attachment (in one example) is in operations and when it is not. Also critical to the resistance and response of the instrument is how sharp these bends are, and whether the cross section of the tubing remains round and that the area of the cross section is maintained. The twin valve system of the present invention both deflects the air pathway the least in the straight horn (with the valve not engaged) and has the fewest degrees of bend within the valve system. Also, the bends are of full bore, and are not "sharp" bends, further enhancing the design, sign, and responsiveness.

It should be noted that although the invention is described as being used as an F-attachment, the invention is not intended to be limited thereto as it can also be used for other notes. Thus, the use of the F-note, F lever, and F-attachment is for illustrative purposes only as one desirable aspect. However, it should be noted that this valve system can be used to add tubing (thus altering the fundamental pitch of the instrument) in many keys. As yet another non-limiting example, in the case of bass trombones, one could use two sets of twin valves, one to lower the instrument from Bb to F, and another from Bb to Gb, and combined from Bb to D. There are many other possible tunings of valve sections possible and desirable according to the invention presented herein.

Figure 2A:
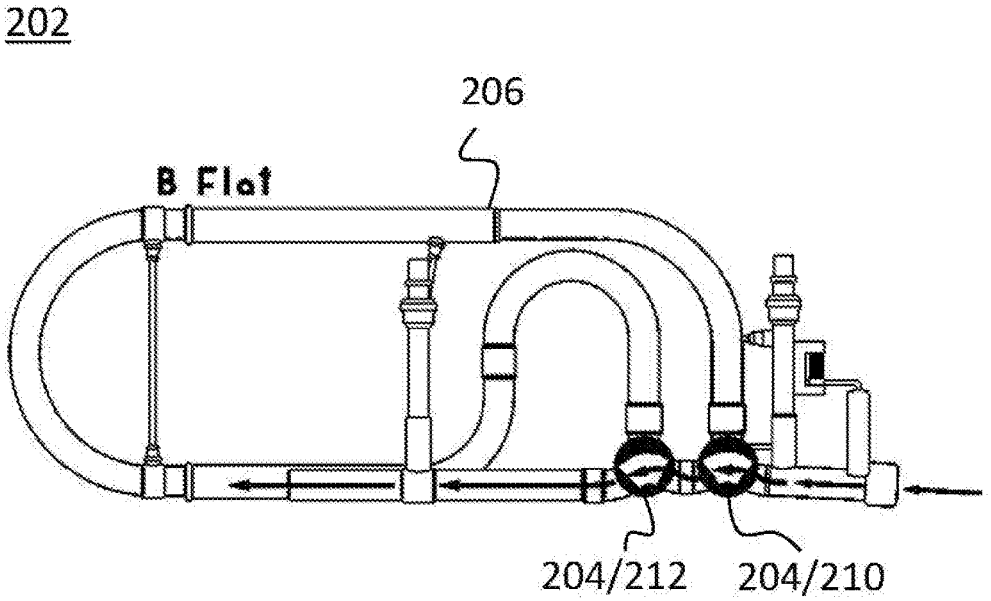
FIG. 2A is a side view illustration of a F-attachment for a trombone according to various embodiments of the present invention, depicting an interior view of twin valves in a B-Flat configuration.

As shown in FIGS. 2A and 28, this disclosure is directed to a twin valve attachment 202 (e.g., F-attachment) for musical instruments. The F-attachment 202 includes two small single port valves 204 that rotate (e.g., 120 degrees, etc.) in tandem to do a job that is traditionally accomplished with one valve.

For example, FIG. 2A depicts an interior view of the twin valves 204 in a B-Flat configuration. In the B-flat configuration, the valves 204 are positioned to direct air flow past the F-attachment 202 and its piping 206. Because the single port within each valve 204 is curved slightly the valves 204 can be rotated to redirect the air flow. The single port within each valve curves to any desired angle to allow for selectively directing air between the B-flat and F note configurations (or any other configurations as designed into the instrument). As a non-limiting example, the single port curves approximately 60 or 120 degrees, or includes any other desired port curvature that allows a single port to direct air between the requisite piping according to the various embodiments of the present invention.

Figure 2B:
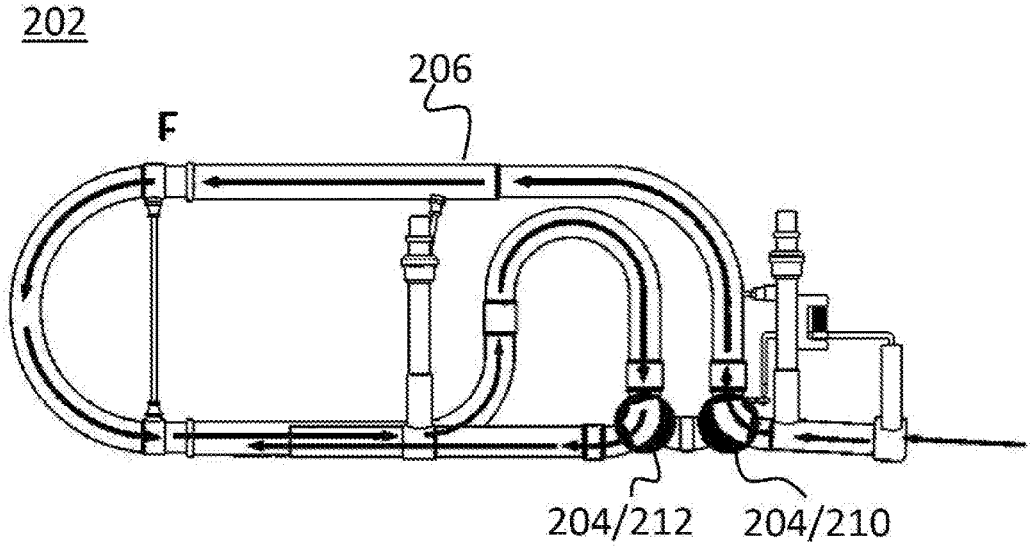
FIG. 2B is a side view illustration of a F-attachment for a trombone according to various embodiments of the present invention, depicting an interior view of twin valves in an F note configuration.

FIG. 2B depicts the twin valves 204 in an F-note configuration. In the F-note configuration, both valves 204 are rotated so that the first valve or input valve 210 directs air flow into the piping 206 of the F-attachment, while the second valve 212 receives the air from the F-attachment 202 and directs the air back through the remaining piping of the musical instrument.

Figure 3A:
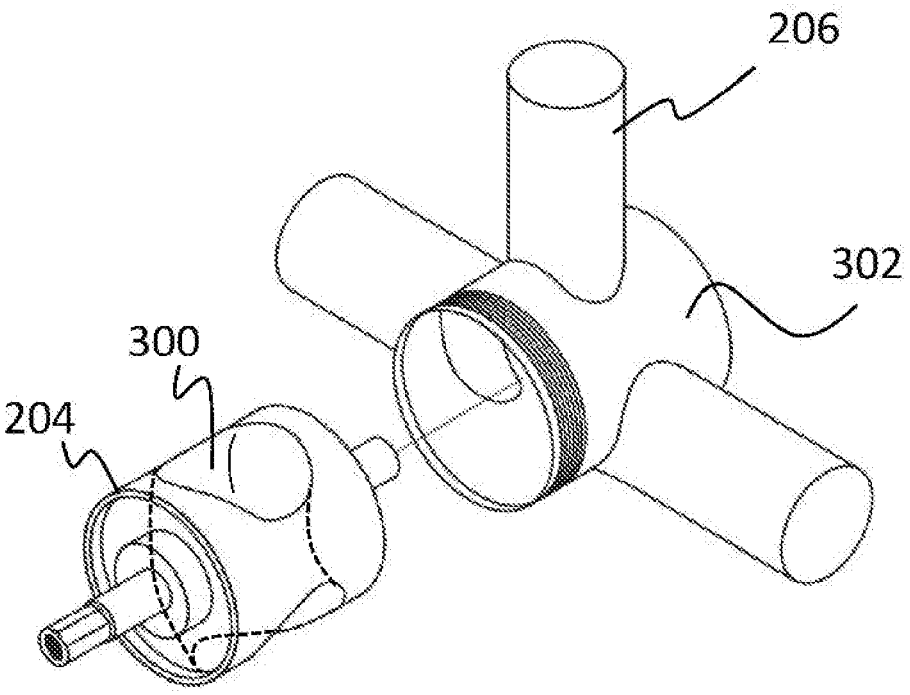
FIG. 3A is an exploded-view illustration of a rotary valve as used in various embodiments of the present invention.

For further understanding, FIG. 3A depicts an exploded-view of a valve 204 as suitable for use as the valves in the F-attachment. The valves 204 as used in the F-attachment can be dissimilar; however, desirably, they are the same and as depicted in FIG. 3A. The individual valves 204 are small in diameter and light, yet have a single port 300 with the full bore of the F-attachment tubing 206. The individual rotary valves 204 allow for a wrap (curvature within the single port) that is more directed with fewer bends than traditional wraps. As shown, the valve 204 is encased within a housing 302 that includes at least three ports or tubes entering the housing 302.

Figure 3B:
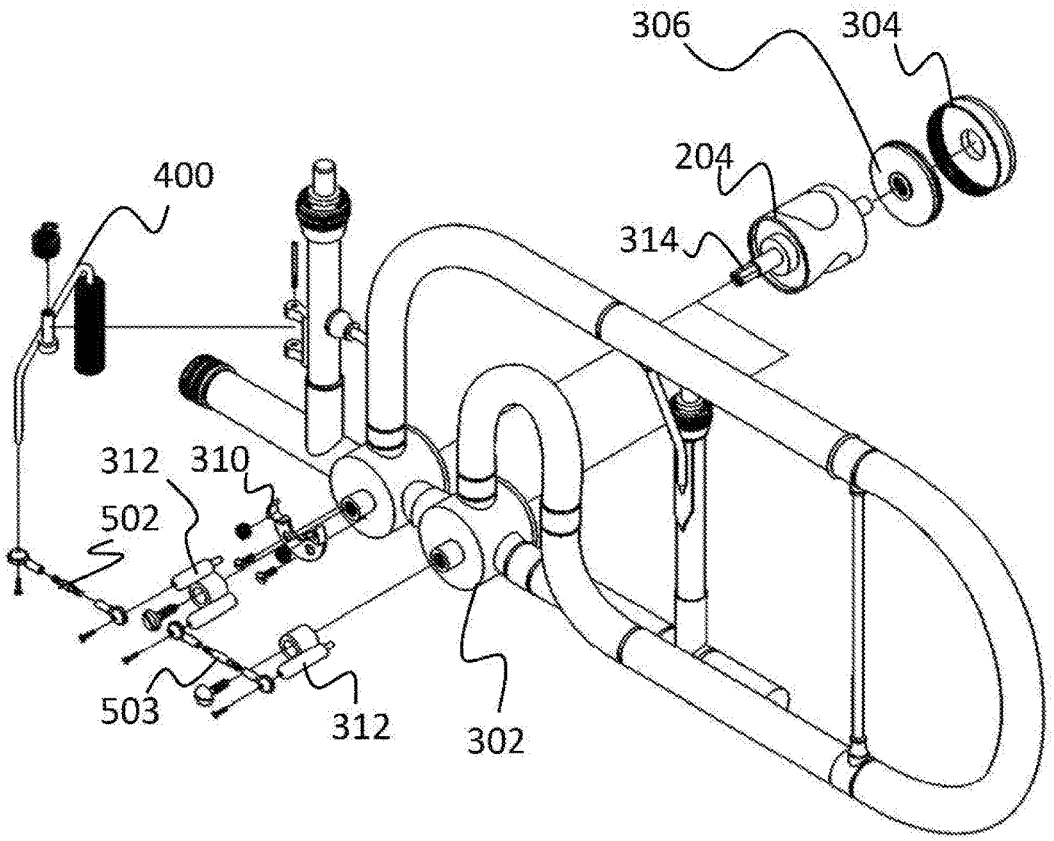
FIG. 3B is an exploded-view illustration of the F-attachment as used in various embodiments of the present invention.

As shown in FIG. 3B, a cover plate 304 (or any other suitable mechanism or device) can be used to affix the valve 204 within the housing 302 using threading or any other technique, etc. A spacer, washer, or bearing 306 can be desirably included to assist the valve 204 in rotating easily within the housing 302. Also shown are an actuator (e.g., lever 400) and linkages 502 and 503 (as described in further detail below). The valves 204 can be connected with the linkages 502 and 503 using any suitable mechanism or device for allowing dual rotation of the valves 204. As a non-limiting example, a limiter 310 is connected with each housing 302 and rotating pin connector 312 can be connected with a post member 314 of each valve 204 (via, for example, a screw). Although a single limiter 310 is depicted in FIG. 3B, it is noted that both valve housings 302 can include such a limiter 310 (as shown in FIG. 4) to limit rotation of the rotating pin connector 312 as turned by the linkages 502 and 503. Thus, the linkages 502 can be affixed (e.g., screwed, etc.) to the rotating pin connectors 312, which are in turn connected with the post members 314 of the valves 204. The rotating pin connectors 312 provide a grasping point for the linkages 502 and 503 to rotate the valve 204 and selectively direct the port to the desired tubes.

Referring again to FIG. 2A, the configuration of the input valve tubing allows for the air stream path to be much less deflected from a straight line on the "open side" (valve not engaged) of the instrument, making it much more like a tenor trombone without a valve. The resulting valve provides an open Bp instrument (e.g., trombone) that is very free and responsive, while the F side of the instrument with the valve engaged (as shown in FIG. 2B) is very open and solid feeling, with a response and sound that is much more matched to the natural instrument than any previous implementation.

Figure 4A:
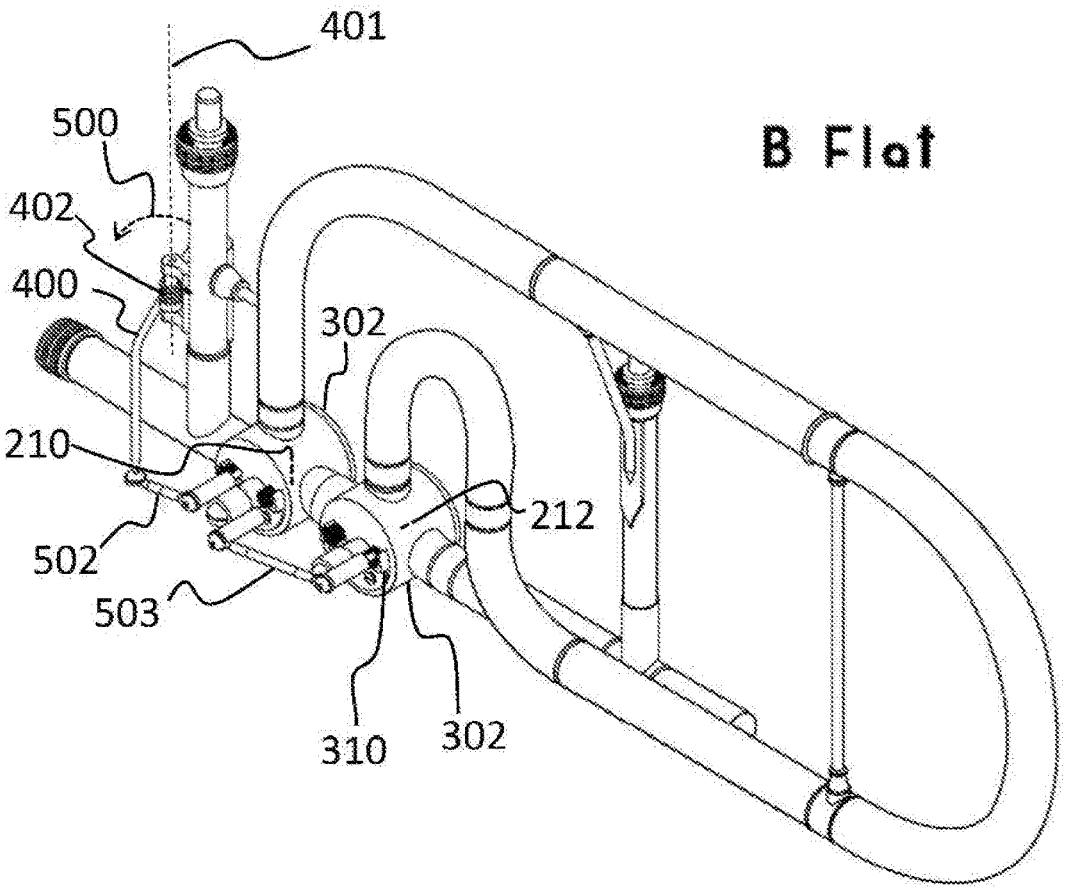
FIG. 4A is an illustration of the F-attachment in the B-Flat configuration.
Figure 4B:
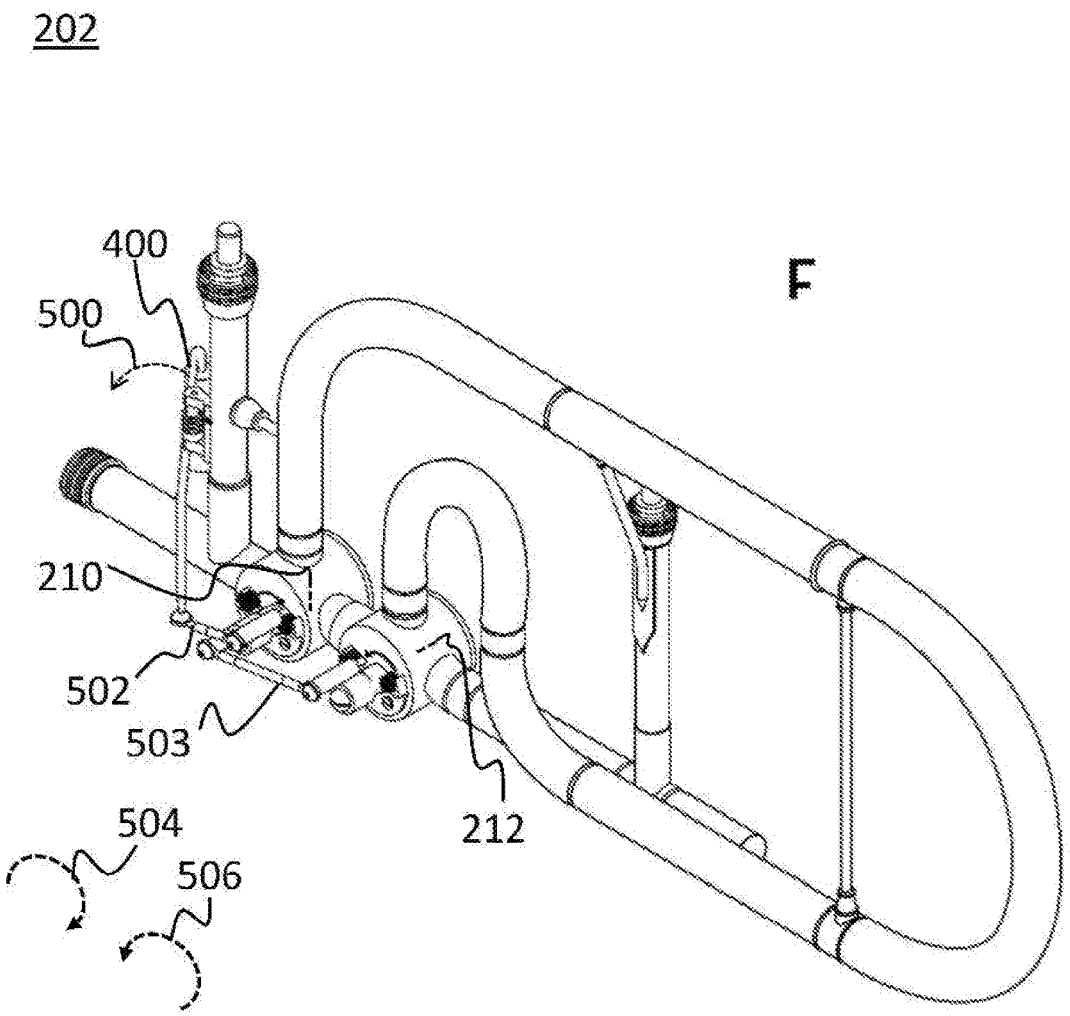
FIG. 4B is an illustration of the F-attachment in the F note configuration.

For further understanding, FIGS. 4A and 4B provide illustrations of the F-attachment 202 in the B-flat and F note configurations, respectively. The valves are positioned within their respective housings 302 and in a configuration to allow air flow to bypass the F-attachment 202 (as shown in FIGS. 2A and 5A). The valves are actuated or otherwise caused to rotate into the F note configuration (as shown in FIG. 4B) using any suitable mechanism or device. As a non-limiting example, an actuator, such as a lever 400 (e.g., F lever) or any other suitable mechanism, and corresponding linkage(s) are used to rotate the valves. The F lever 400 is pivotally attached with the F-attachment 202 (or other component on the musical instrument) using any suitable mechanism or device that allows rotation between two components (e.g., a hinge) to allow the F lever 400 to rotate about a pivot point 401. The F lever 400 is desirably spring-loaded 402 or biased to maintain at rest in the B-flat configuration (or in other aspect, biased into the F note configuration).

Figure 5B:
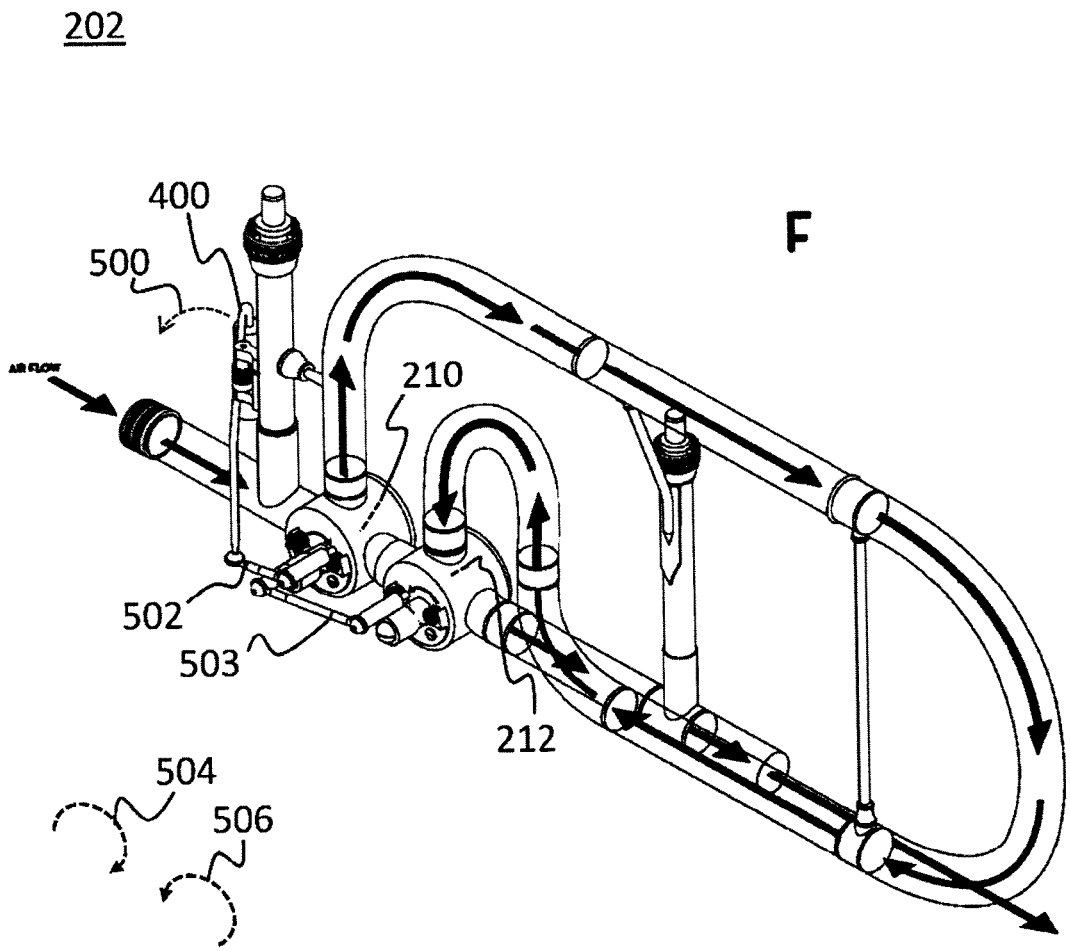
FIG. 5B is an illustration of the F-attachment in the F note configuration, depicting air flow as passing through the F-attachment.
Figure 5A:
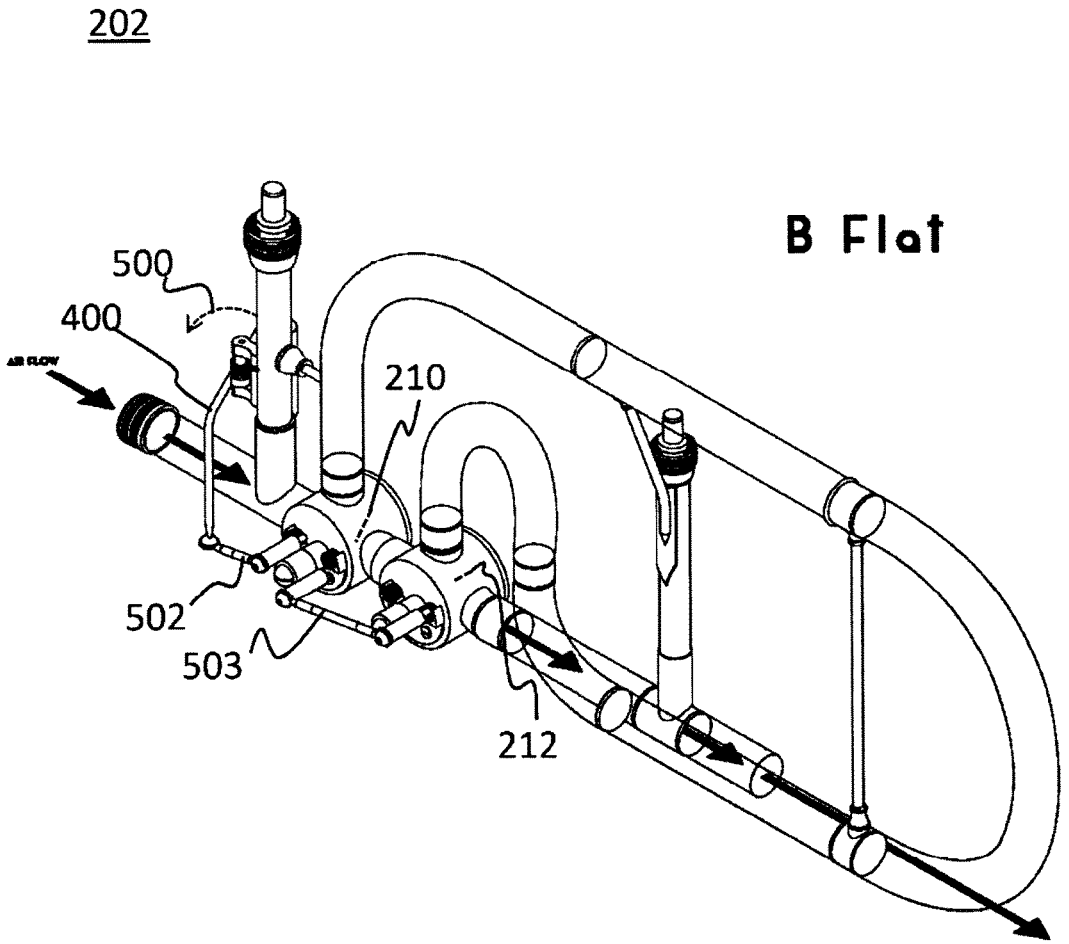
FIG. 5A is an illustration of the F-attachment in the B-Flat configuration, depicting air flow as bypassing the F-attachment.

As shown between FIGS. 4A through 5B, when the F lever 400 is actuated (such as being rotated 500 away from the player), connected linkages are used to rotate the valves into the F note configuration (or the process is reveres to rotate the valves into the B-flat configuration). As a non-limiting example, the F lever 400 is operably linked to the input valve 210 with a first linkage 502. The input valve 210 is then operably linked (via a second linkage 502) to the second valve 212. In some embodiments, the connection points of the linkages to the valve casings are positioned such that rotation (via the first linkage 502) of the input valve 210 in a first rotational direction 504 causes the second linkage 503 to rotate the second valve 212 in a second and opposite rotational direction 506 (as shown in FIGS. 4B and 5B). Thus, as shown in FIG. 5A, when the valves are in the B-flat configuration, the air flow bypasses the F-attachment 202. Alternatively and as shown in FIG. 5B, when the valves in the F note configuration, air flow is directed through the F-attachment 202.

Figure 5C:
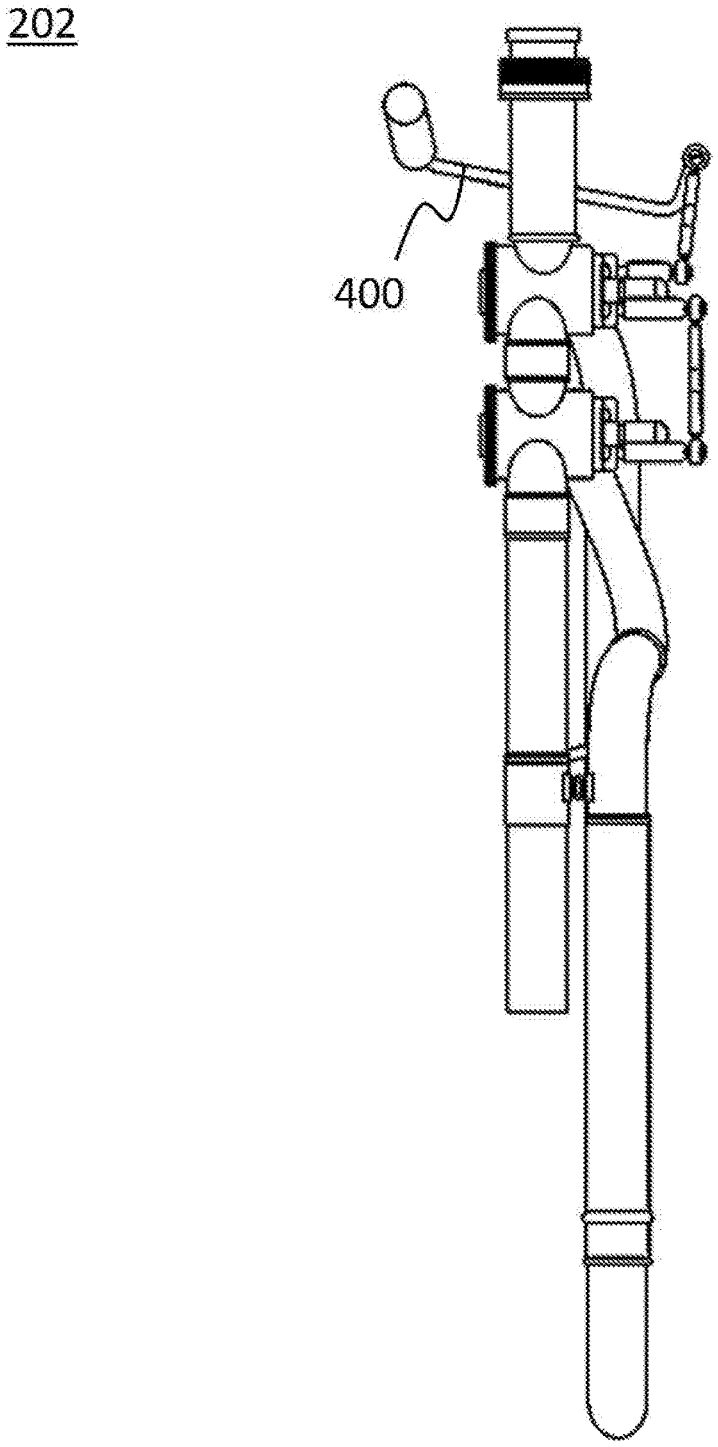
FIG. 5C is a bottom-view illustration of the F-attachment, depicting an F lever in the B-flat configuration.
Figure 5D:
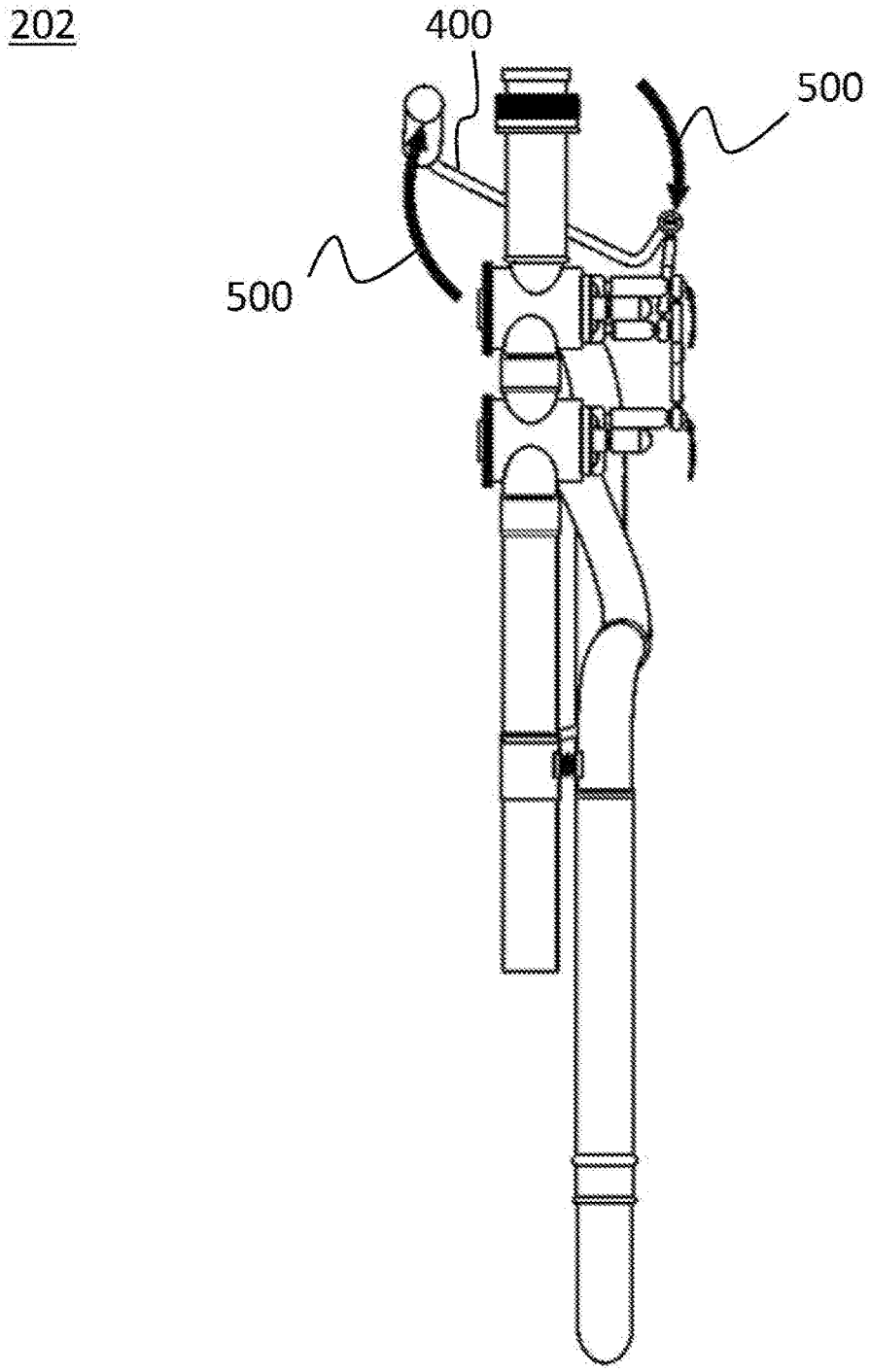
FIG. 5D is a bottom-view illustration of the F-attachment, depicting the F lever in the F note configuration.

For further understanding, FIGS. 5C and 5D illustrates the F lever between the two configurations. More specifically, FIG. 5C is a bottom-view illustration depicting the F-lever 400 in the B-flat configuration. Alternatively, FIG. 5D illustrates the F-lever 400 being rotated 500 into the F note configuration.

Figure 6:
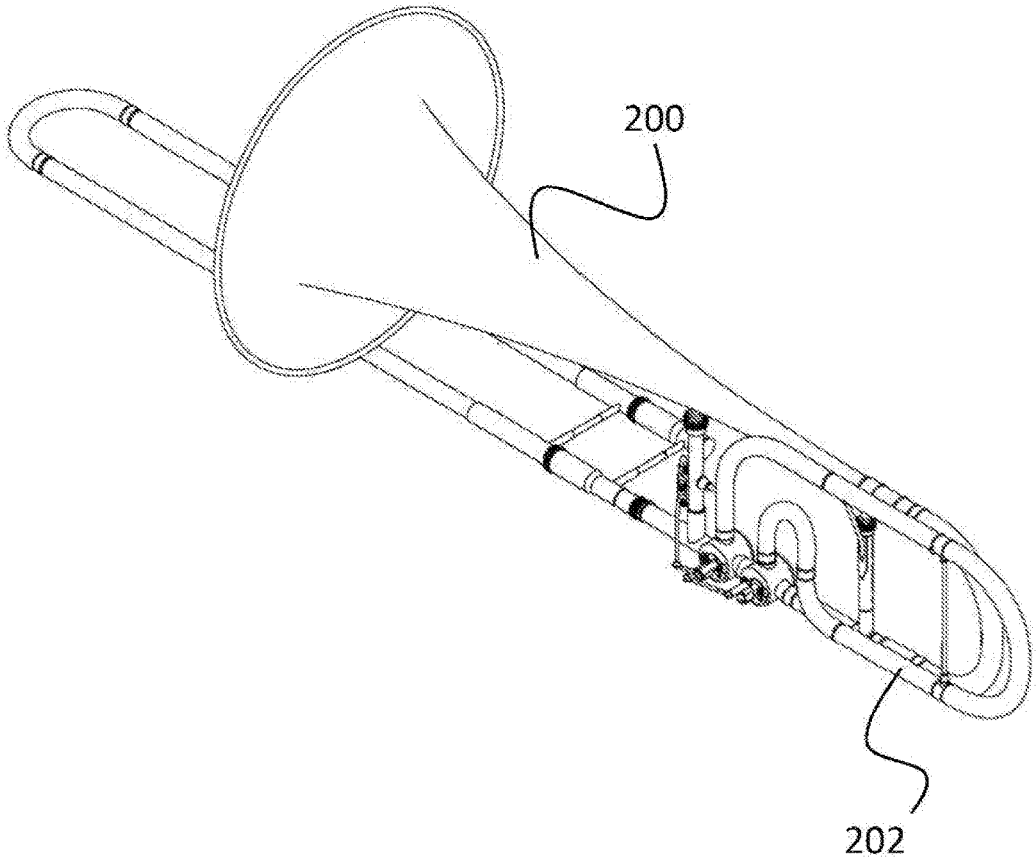
FIG. 6 is an illustration of a trombone incorporating the F-attachment according to various embodiments of the present invention.

As noted above, the F-attachment 202 can be incorporated into any musical instrument in which it is desirable to redirect air flow through the use of a rotary valve. Desirably and as shown in FIG. 6, the musical instrument 200 is a trombone. Thus, as depicted, the F-attachment 202 and its twin valves are connected with the trombone to allow a player to utilize the F-attachment 202 to extend his playing into the lower register, maintaining a very similar sound and response to the rest of the instrument.

As noted above and repeated for clarity, the twin valve described herein can be used for a number of instruments to transition between notes. Thus, the use of the F and B notes and corresponding language (F lever, F-attachment, etc.) is used for illustrative purposes only of one aspect; however, it should be understood that the invention not intended to be limited thereto. Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. A twin valve attachment for musical instruments, comprising:

an actuator, the actuator positionable between at least two configurations;

a first rotary valve operably connected with the actuator, the first rotary valve having a first rotary valve port passing therethrough;

a second rotary valve operably connected with the first rotary valve, the secondary rotary valve having a second rotary valve port passing therethrough;

attachment piping fluidly connected with both the first and second rotary valves, whereby a user may move the actuator to selectively direct air flow through the attachment piping or bypass the attachment piping; and wherein the first rotary valve is rotatable between a first configuration and a second configuration, such that when in the first configuration, the first rotary valve port is directed to fluidly bypass the attachment piping and, when in the second configuration, the first rotary valve port is directed to fluidly connect with the attachment piping.

2. The twin valve attachment as set forth in claim 1, wherein the second rotary valve is rotatable between a first configuration and a second configuration, such that when in the first configuration, the second rotary valve port is directed to fluidly bypass the attachment piping and, when in the second configuration, the second rotary valve port is directed to fluidly connect with the attachment piping.

3. The twin valve attachment as set forth in claim 2, wherein the first and second rotary valves are operably connected with the actuator via linkages such that actuation of the actuator causes the first and secondary rotary valves to rotate in opposite rotational directions.

4. The twin valve attachment as set forth in claim 3, wherein the first and second rotary valves are operably connected with the actuator via linkages such that actuation of the actuator causes the first and secondary rotary valves to each rotate approximately 120 degrees.

5. The twin valve attachment as set forth in claim 4, wherein the first and second rotary valve ports are curved ports that curve approximately 120 degrees.

6. The twin valve attachment as set forth in claim 5, wherein the first configuration is a B-Flat configuration and wherein the second configuration is an F note configuration, with the attachment piping being an F-attachment piping.

7. The twin valve attachment as set forth in claim 6, wherein the actuator is a spring-loaded F-lever biased in the B-Flat configuration.

8. A twin valve attachment for musical instruments, comprising:

an actuator, the actuator positionable between at least two configurations;

a first rotary valve operably connected with the actuator, the first rotary valve having a first rotary valve port passing therethrough;

a second rotary valve operably connected with the first rotary valve, the secondary rotary valve having a second rotary valve port passing therethrough;

attachment piping fluidly connected with both the first and second rotary valves, whereby a user may move the actuator to selectively direct air flow through the attachment piping or bypass the attachment piping; and wherein the second rotary valve is rotatable between a first configuration and a second configuration, such that when in the first configuration, the second rotary valve port is directed to fluidly bypass the attachment piping and, when in the second configuration, the second rotary valve port is directed to fluidly connect with the attachment piping.

9. A twin valve attachment for musical instruments, comprising:

an actuator, the actuator positionable between at least two configurations;

a first rotary valve operably connected with the actuator, the first rotary valve having a first rotary valve port passing therethrough;

a second rotary valve operably connected with the first rotary valve, the secondary rotary valve having a second rotary valve port passing therethrough;

attachment piping fluidly connected with both the first and second rotary valves, whereby a user may move the actuator to selectively direct air flow through the attachment piping or bypass the attachment piping; and wherein the first and second rotary valves are operably connected with the actuator via linkages such that actuation of the actuator causes the first and secondary rotary valves to rotate in opposite rotational directions.

10. A twin valve attachment for musical instruments, comprising:

an actuator, the actuator positionable between at least two configurations;

a first rotary valve operably connected with the actuator, the first rotary valve having a first rotary valve port passing therethrough;

a second rotary valve operably connected with the first rotary valve, the secondary rotary valve having a second rotary valve port passing therethrough;

attachment piping fluidly connected with both the first and second rotary valves, whereby a user may move the actuator to selectively direct air flow through the attachment piping or bypass the attachment piping; and wherein the first and second rotary valves are operably connected with the actuator via linkages such that actuation of the actuator causes the first and secondary rotary valves to each rotate approximately 120 degrees.

11. A twin valve attachment for musical instruments, comprising:

an actuator, the actuator positionable between at least two configurations;

a first rotary valve operably connected with the actuator, the first rotary valve having a first rotary valve port passing therethrough;

a second rotary valve operably connected with the first rotary valve, the secondary rotary valve having a second rotary valve port passing therethrough;

attachment piping fluidly connected with both the first and second rotary valves, whereby a user may move the actuator to selectively direct air flow through the attachment piping or bypass the attachment piping; and wherein the first and second rotary valve ports are curved ports that curve approximately 120 degrees.

12. A twin valve attachment for musical instruments, comprising:

an actuator, the actuator positionable between at least two configurations;

a first rotary valve operably connected with the actuator, the first rotary valve having a first rotary valve port passing therethrough;

a second rotary valve operably connected with the first rotary valve, the secondary rotary valve having a second rotary valve port passing therethrough;

attachment piping fluidly connected with both the first and second rotary valves, whereby a user may move the actuator to selectively direct air flow through the attachment piping or bypass the attachment piping; and wherein the first configuration is a B-Flat configuration and wherein the second configuration is an F note configuration, with the attachment piping being an F-attachment piping.

13. A twin valve attachment for musical instruments, comprising:

an actuator, the actuator positionable between at least two configurations;

a first rotary valve operably connected with the actuator, the first rotary valve having a first rotary valve port passing therethrough;

a second rotary valve operably connected with the first rotary valve, the secondary rotary valve having a second rotary valve port passing therethrough;

attachment piping fluidly connected with both the first and second rotary valves, whereby a user may move the actuator to selectively direct air flow through the attachment piping or bypass the attachment piping; and wherein the actuator is a spring-loaded F-lever biased in the B-Flat configuration.

* * * * *